US006260555B1

(12) United States Patent
Natvig

(10) Patent No.: US 6,260,555 B1
(45) Date of Patent: Jul. 17, 2001

(54) METHOD OF RETAINING HUMAN HAIR

(76) Inventor: Alisa Natvig, 258 Harvard St, #111, Brookline, MA (US) 02446

( * ) Notice: Subject to any disclaimer, the term of this patent is extended or adjusted under 35 U.S.C. 154(b) by 0 days.

(21) Appl. No.: 09/527,506

(22) Filed: Mar. 16, 2000

(51) Int. Cl.[7] ..... A45D 24/00
(52) U.S. Cl. ..... 132/200; 132/273
(58) Field of Search ..... 132/273, 275, 132/200; 119/607, 809, 811; 54/78; D30/144; 2/170, 338, 171, 311, 312

(56) References Cited

U.S. PATENT DOCUMENTS 289,873 * 12/1883 Vail ..... 54/78
385,721 * 7/1888 Muntz ..... 54/78
537,542 * 4/1895 Moore ..... 132/273
639,064 * 12/1899 Lancaster ..... 54/78
703,531 * 7/1902 Brown ..... 132/273
1,146,934 * 7/1915 Gleeson ..... 132/273
4,378,667 * 4/1983 Velarde, Jr. ..... 54/78
5,279,255 * 1/1994 Northcutt ..... 119/83
5,472,003 * 12/1995 Frame et al. ..... 132/275

* cited by examiner

*Primary Examiner*—Gene Mancene
*Assistant Examiner*—Eduardo C. Robert
(74) *Attorney, Agent, or Firm*—Charles G. Call

(57) ABSTRACT

A braid and ponytail holder consisting of a panel formed from flexible material such as leather. Pairs of rivet-on lacing studs are attached to the panel near its opposing edges of the panel so that, when the panel is curled to form a tubular sheath, the two studs are adjacent to one another. A lacing strand which is captured by the outwardly extending hook portion of each of the lacing studs draws the studs together so that the sheath surrounds and firmly retains the hair. A clasp, such as a small ring or ferrule, secures the free ends of the lacing strands to secure the holder in place around the braid or ponytail.

4 Claims, 1 Drawing Sheet

METHOD OF RETAINING HUMAN HAIR

FIELD OF THE INVENTION

This invention relates to hair accessories and more particularly to a holder for braids or ponytails.

SUMMARY OF THE INVENTION

It is an object of the present invention to provide a braid and ponytail holder which is an attractive fashion accessory, which securely holds the hair in place, which is easy to attach and remove, and which may be readily and inexpensively fabricated from readily available components and materials.

The preferred embodiment of the present invention takes the form of a braid and ponytail holder consisting of a panel formed from a suitable flexible material to which are attached one or more pairs of rivet-on lacing studs. The two studs in each pair are positioned near the opposing edges of the panel so that, when the panel is wrapped around the hair to form a tubular sheath, the two studs in each pair are adjacent to one another. A lacing strand is passed around and is captured by the outwardly extending hook portion of the opposing studs, and draws the studs together so that the sheath is secured to and firmly retains the hair. A clasp, which may take the form of a ring or ferrule which slips over and frictionally retains the free ends of the lacing strand, secures the lacing strand after it is tightened.

Braid and ponytail holders which are fabricated in accordance of the invention may be sized and configured for different sizes and styles of braids and ponytails. A particularly attractive holder employs natural or imitation leather for both the panel and the lacing strand, and uses brass lacing studs. The panel and the lacing strand may be colored with the same or complementary colors, and the panel may be decorated with graphical patterns or ornamentation, such as beadwork. A clear plastic material may be used for the panel. Velvet ribbons and ribbons made of other material may be used as a lacing. The lacing studs may be formed from metals other than brass, including steel and nickel, or from plastic colored to match or contrast with the panel.

Although the use of hook-like lacing studs is normally preferred, metal or plastic eyelets of the type used in shoes may be substituted for some or all of the lacing studs. The substitution of eyelets reduces the cost of the holder, and results in a flatter appearance which some may prefer.

These and other features of the invention will become more apparent by considering the following detailed description. In the course of this description, frequent reference will be made the attached drawings.

DETAILED DESCRIPTION

Figure 1:
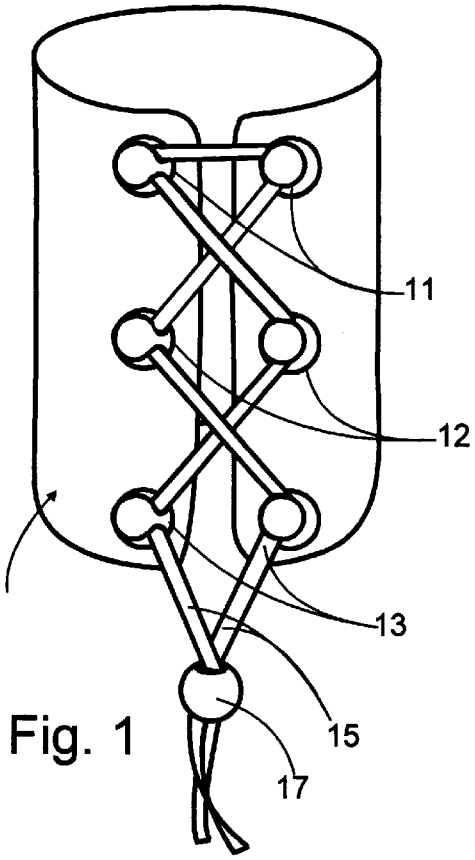
FIG. 1 is a perspective view of a braid and ponytail holder using three pairs of lacing studs.
Figure 6:
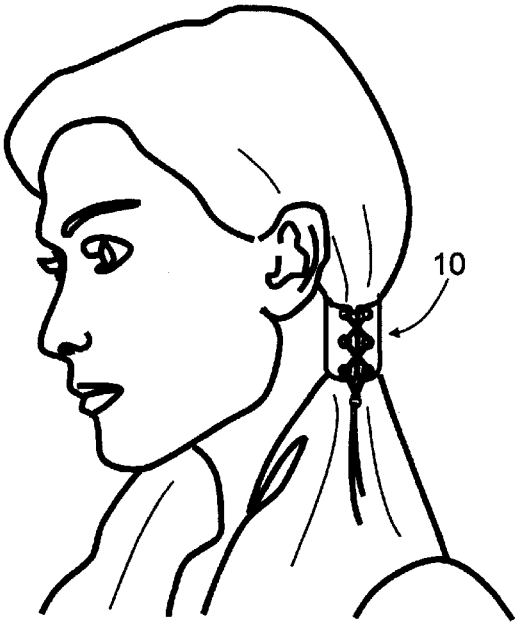
FIG. 6 illustrates how the braid and ponytail holder of FIG. 1 is attached to the hair.

As seen in FIG. 1, a ponytail holder constructed in accordance with the invention consists of a flexible panel which can be easily wrapped around the hair to form a ponytail, with two of the panel's opposing edges being brought into proximity with one another so that the panel forms a substantially cylindrical sheath which surrounds and retains the hair as depicted in FIG. 6. As used herein, the term "ponytail" and "ponytails" should be understood to refer to one or more braids, ponytails or pigtails. The ponytail holder shown in FIGS. 1 and 6 employs three pairs of rivet-on lacing studs which capture a lacing strand 15 whose two free ends are pass through and are retained by a clasp 17 when the lacing strand is tightened to secure the ponytail holder to the hair.

The panel 10 may be made of any suitable flexible material, such as natural or imitation leather, or a fabric. The lacing strand 15 may also be made of any suitable material, such as leather, ribbon or a cord formed by twisted or woven strands. The clasp 17 may take the form of a simple ring or ferrule having an inside dimension sized to slidably receive both two free ends of the lacing strand, permitting the strand 15 to be tightened or release by applying moderate force while still frictionally retaining the lacing strand in place during normal use.

The conventional rivet-on lacing studs are attached to the panel as seen at 11–15 in FIGS. 1 and 6, and as indicated by the unnumbered circles in FIGS. 2–5. Each stud consists of a hook support base to which an L-shaped lacing hook extends outwardly, and a rivet post which secures the stud to the panel. Using a conventional hole punch or the like, a small hole is first cut into panel, and the rivet post is inserted through the hole. Using a riveting tool, the rivet post is deformed, crimping the post so that the panel is clamped between the hook support base and a backing washer, securing the stud in place on the sheet with the open portion of each hook facing away the other stud in the pair which is positioned near the opposing edge of the panel. Suitable lacing studs are commonly machined from solid brass for strength, durability and attractiveness, are typically used in the construction of leather hiking boots and the like, and are readily available through leather goods suppliers and fastener supply outlets, such as Dexter Leather, South Boston, Mass. and UMX- Universal Mercantile Exchange, Inc., Baldwin Park, Calif. The lacing studs may also be constructed from other metals, such as nickel or brass, or formed from molded plastic in any desirable color.

As noted earlier, eyelets of the type used in the fabrication of shoes and boots may be substituted for some or all of the lacing studs seen at 11–15. Like the lacing studs, these eyelets are readily available through leather goods and fastener supply outlets, and may likewise be formed from brass, steel, nickel or other metals, or from plastic.

When loosened, the lacing 15 may be completely disengaged from the lace hooks provided by the studs 11–13 In this way, the panel 10 may be easily removed from the hair. To form a braid or ponytail, the panel 10 is wrapped around the hair and the lacing 15, held in a loop by the clasp 17, can be easily laced onto the hooks 11–13, drawn tight, and held in place by sliding the clasp 17 over the free ends of the lacing 15 towards the panel 10. Alternatively, the lacing may be simply loosened, and the hair extracted from the sheath, without unlacing the strand 15 from the lacing studs, and then the hair can be later reinserted through the sheath and the lacing tightened.

Figure 2:
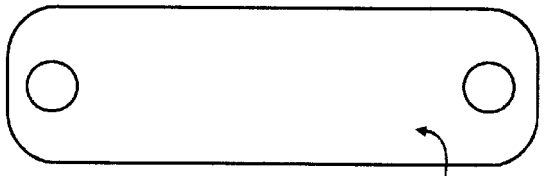
FIG. 2 is a plan view of a braid and braid and ponytail holder having a single pair of lacing studs for use with a braid or small ponytail.
Figure 3:
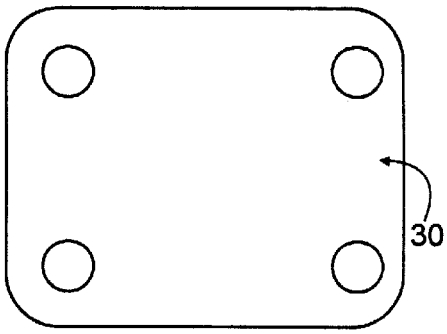
FIG. 3 is a plan view of a braid and ponytail holder having two pairs of lacing studs attached to a narrower panel which is suitable for holding a smaller, side-of-the-head braid, ponytail or "pigtail;"
Figure 4:
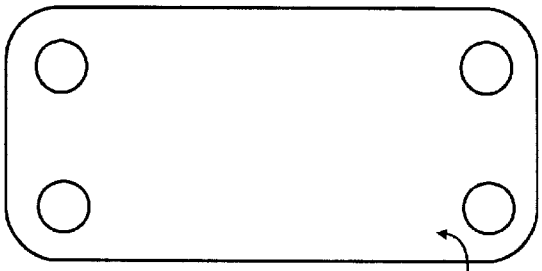
FIG. 4 is a plan view of a braid and ponytail holder having two pairs of lacing studs attached to a wider panel for use with a medium braid or ponytail.
Figure 5:
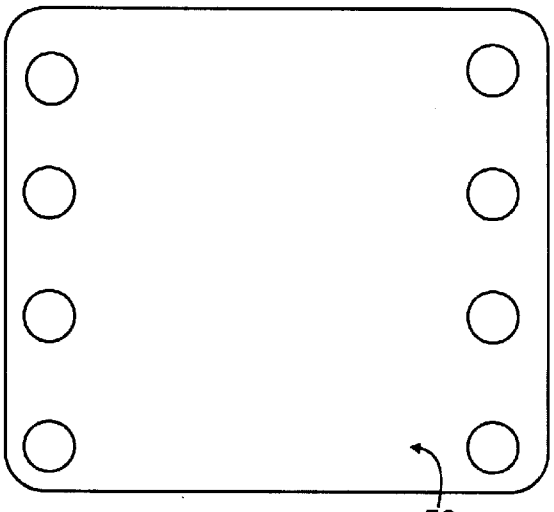
FIG. 5 is a plan view of holder having four pairs of lacing studs attached to a longer and wider panel for use with a large braid or ponytail.

The flexible panel which forms the sheath for holding the ponytail, as illustrated at 10 in FIGS. 1 and 6, and at 20, 30, 40, and 50 respectively in FIGS. 2–5, is preferably substantially rectangular with rounded corners. A variety of panel sizes, with varying numbers of pairs of lacing studs, can be used to form braid and ponytail holders suitable for different wearers and hair styles. The panel 10 shown in FIGS. 1 and 6, to which 3 pairs of lacing studs are attached, is preferably about 2.25 inches wide and 2.4 inches tall, making it suitable for use with each of two, side-of-the-head ponytails for an adult. Other exemplary panel sizes (in inches) and stud configurations are shown in the plan views of FIGS. 2–5 and listed in the following table.:

| FIG. | Width | Height | Stud Pairs | Typical Use |
|---|---|---|---|---|
| FIG. 2 | 3-¾" | 1" | 1 | small braid or ponytail |
| FIG. 3 | 2-½" | 2" | 2 | side of head ponytail (pigtail) |
| FIG. 4 | 3-¼" | 1-½" | 2 | medium ponytail |
| FIG. 5 | 3-½" | 3" | 4 | large ponytail |

It is to be understood that the specific arrangements which have described above are merely illustrative applications of the principles of the invention. Numerous modifications may be made to the braid and ponytail holders which have been described without departing from the true spirit and scope of the invention.

What is claimed is:

1. The method of retaining human hair which comprises, in combination, the steps of:

gathering human hair into a ponytail or braid, wrapping a substantially rectangular panel of flexible material around the gathered hair such that two opposing edges of said panel are moved into proximity with one another to form a sheath for retaining said gathered hair, said panel having at least one pair of lacing holders affixed near said opposing edges, attaching a strand of lacing to said lacing holders, and tightening said strand of lacing to secure said gathered hair within said sheath.

2. The method of retaining human hair set forth in claim 1 further comprising the step of employing a clasp to secure the free ends of said strand of lacing when tightened about said lacing holders.

3. The method as set forth in claim 1 further comprising the step of inserting the two free ends of said strand of lacing into a ring-shaped member having an inside diameter of said ring-shaped member sized to frictionally secure said free ends in place.

4. The method as set forth in claim 1 wherein said lacing holders take the form of hook-shaped lacing studs.

* * * * *